US009566490B2

(12) United States Patent
Hoffman

(10) Patent No.: US 9,566,490 B2
(45) Date of Patent: Feb. 14, 2017

(54) BASKETBALL SHOOTING TRAINING AND BALL RETURN

(71) Applicant: Daniel L. Hoffman, Edmond, OK (US)

(72) Inventor: Daniel L. Hoffman, Edmond, OK (US)

( * ) Notice: Subject to any disclaimer, the term of this patent is extended or adjusted under 35 U.S.C. 154(b) by 146 days.

(21) Appl. No.: 13/999,642

(22) Filed: Mar. 14, 2014

(65) Prior Publication Data

US 2016/0051880 A1 Feb. 25, 2016

(51) Int. Cl.

| | |
|---|---|
| ***A63B 69/00*** | (2006.01) |
| ***A63B 63/00*** | (2006.01) |
| ***A63B 63/08*** | (2006.01) |
| *A63B 71/06* | (2006.01) |

(52) U.S. Cl.

CPC ..... *A63B 69/0071* (2013.01); *A63B 63/007* (2013.01); *A63B 63/083* (2013.01); *A63B 2071/0694* (2013.01); *A63B 2210/50* (2013.01)

(58) Field of Classification Search

USPC ..... 473/447, 448, 472, 433, 479, 434,473/480–489, 422; 273/317, 317.1, 317.3, 397, 273/402, 407; 434/247

See application file for complete search history.

(56) References Cited

U.S. PATENT DOCUMENTS 6,913,551 B1 * 7/2005 Foley ..... A63B 63/083 248/206.2

2009/0042673 A1 * 2/2009 Radice ..... A63B 69/0071 473/447

* cited by examiner

*Primary Examiner* — Gene Kim
*Assistant Examiner* — Rayshun Peng

(57) ABSTRACT

A training device for thrown or pitched balls at a target is disclosed, especially useful for basketball training, in which a hyperbolic paraboloid surface deflects the approaching ball at a known angle in a manner in which the returned ball will strike a mat. The mat includes indicia which can be diagnostically useful in determining the proper correction to the throw or pitch.

14 Claims, 7 Drawing Sheets

BASKETBALL SHOOTING TRAINING AND BALL RETURN

CROSS-REFERENCE TO RELATED APPLICATIONS

This application relates and claims priority to U.S. Provisional Patent Application Ser. No. 61/785,768 filed 14 Mar. 2013, the disclosure of which is incorporated by reference herein in its entirety.

FIELD OF THE INVENTION

This invention pertains to training devices for thrown, pitched, or otherwise projected articles such as balls, and especially for scenarios in which the projected article must reach, hit, or pass through a target, such as a basketball goal or hoop.

BACKGROUND OF INVENTION

Learning to throw or pitch an object, such as a ball, at a target upon which the object is to impact or pass through can be difficult, especially for younger players of games such as basketball, baseball, and football, because their body height, arm lengths, muscular power and quickness change throughout their cycle of maturation. Learning to throw or shoot a ball actually is an on-going process, because the motor motion and viewing angle of the target is different at each different particular body size and relative dimensions, which much relearning is required as the body changes size and proportions. To add to this challenge is the fact that, in some games, the game court dimensions, goal dimensions and ball size and weight are different for different age brackets. As such, while playing "little league" sports may appear simplistic, younger growing players face many challenges that mature, early adult players do not face and vice versa.

During the later adult aging processes, similar changes occur, but they occur in muscle strength, muscle quickness, slight changes in height, and reduced visual acuity. This also makes practice into more of an on-going learning process for adults, as well, even though many players do not recognize this.

Many training devices such as pitch-back targets (football, baseball) and restricted opening targets (football, baseball, and basketball) indicate an error in the pitch, throw, or shot, but they do not provide feedback to the player as to what changes or compensation to make to correct the error. Additionally, return devices tend to be bulky, large, and complicated. Targets fail to accurately define a finite point of aim and/or angles of launch. Targets fail to define an angle of entry. Other training processes fail to define a successful shot as one which is defined to maximize tolerance (centering of opportunity).

Turning to basketball, early in the history of the sport inventors used an apparatus having a circular hoop of smaller diameter placed acutely above and attached to the front of the regulation hoop as a guide to increase or assure a prescribed arc. This apparatus also had a restricted area of passage through which the practice toss of a basketball was then required to pass through to indicate a successful shot.

Since those early attempts at constructing a training aid/apparatus, numerous attempts have been invented featuring other devices providing feedback training, including: ball return; aiming and or reduced size hoop targeting devices; "proper" arc guidance or modifiers; nets; ramps, motorized directional ball return systems, video capture of visual and radio frequency indicated projectile motion path detection systems.

The complexity of the Physics associated with motion of a sphere through a fluid (air resistance) under the influence of acceleration of positive and negative values for gravitational pull between point of launch (release) and optimum passage through a horizontally disposed hoop of "reported" diameter of 18 inches (about 46 centimeters) at a commonly referred to distance of 15 feet (about 4.6 meters) for the free throw. It is not uncommon to dismiss the effect of air drag when studying or writing problems associated with motion equations as they relate/apply to basketball motion equations.

The training devices generally have been static, tethered or rotatably mounted to give way to allow the practice basketball to pass through the hoop thereby providing an immediate visual outcome. The return device portion of these training devices included massive cages, nets or shroud effects, and the arc identifiers involved computerized tracking and audible feedback which required interpretation or translation to kinetic terms and/or provide delayed result reporting.

The misinformation (myths) 18 inch (about 46 centimeters) diameter hoop when measured at center of cross section of ⅝ inch (about 1.7 centimeter) rod, is that there is an effective vertical clearance diameter of 17⅜ inches (about 44.1 centimeters). The common measure cited for the free throw is 15 feet (about 4.6 meters), which is the distance from the free throw line to the front plane of the backboard extended to the floor. The swish shot fails to maximize the opportunity for successful passage through the hoop.

The failure of athletes to comprehend and then adjust to the physics based changes associated with player growth, including increased height which modifies variables of the motion equation and then decreases the viewing angle to the basket, leads to diminishing results to many taller or tallest players.

With a range of release points from shortest to tallest players being greater than the range in player heights e.g. 5.0 feet to 7.7+ feet (about 1.5 meters to about 2.4+ meters) one angle of launch or arc definition fails to satisfy the need throughout the range of players in the sport.

What is needed is an easy to understand and easy to use accurate training aid and method to assist the individual player identify and practice to perfection targeting. Preferably, the training aid will include a ball return apparatus and training guide and score/record keeping system to identify and/or reinforce the most successful percentages for fixed length shot attempts through a series of visual and virtual targets. Preferably, the visual and virtual which aid the player in establishing a comprehension based training aid and system of use through motion equations including the effect of air drag to establish personal benchmarks for establishing a stance. The stance needs to be one which assures a point of launch in the trajectory plane. The repeatability of the stance is a result of using a repeatable method of aim to achieve an angle of entry to the hoop and to maximize the opportunity to center the ball within the maximized tolerance goal with minimal contacts with the rim on the downward flight of the ball as projected by a player using a one hand over hand release.

SUMMARY OF THE DISCLOSURE

In one aspect a training device is provided. The training device comprising a basketball goal, a center axis, a defined surface, a first linear distance, a hoop target, floor target, and a top aiming indicia. The basketball goal has a backboard, a rim and a net. The center axis is disposed through the rim. The defined surface has the basketball goal positioned thereabove a set height, wherein the backboard is perpendicular to the define surface, wherein the center axis is parallel with the backboard and intersects the defined surface at an intersection point. The first linear distance is between a point on a shooting line and the intersection point. The hoop target is affixed to the basketball goal and positioned above the rim in a position laterally centered over the rim. The floor target is positioned on the defined surface, the floor target being removable and having a center indicator and at least one error indicator, wherein the floor target is positioned a second linear distance from the intersection point. The top aiming indicia is positioned on the hoop target and is visible from the shooting line. Wherein the position of the hoop target and the floor target are configured to provide optimized training for an operator shooting a basketball from the point on the shooting line towards the hoop target, wherein an optimum shot is when the operator shoots the basketball toward the top aiming indicia and the basketball bounces back towards the operator and lands in the center indicator and further bounces back to the operator.

In one aspect, a hoop target is provided. The hoop target comprises a body, a surface, a top aiming indicia, and a target centerline. The body is generally cylindrically/elliptically shaped and having a hyperbolic parabaloid shaped surface, wherein the hyperbolic parabaloid shaped surface has a concave surface and a convex surface, the concave and convex surfaces configured to provide a return origination surface.

A target centerline, wherein the concave surface extends outwardly therefrom. A nearly flat trough positioned on the convex surface, wherein the convex surface further comprises an increasingly angled slope towards at least one lateral edge. A first color associated with the top aiming indicia. A second color associated with the top aiming indicia.

In another aspect, a method of training to shoot a basketball, the method comprising the steps of:

a. positioning a hoop target above a rim of a basketball goal backboard, wherein the hoop target has a return origination surface with a top aiming indicia thereon and is centered laterally on a center axis of the rim, wherein the center axis is parallel to a plane of the backboard and intersects a defined surface below the rim at an intersection point;
b. selecting a point on or near a shot line, the shot line being on the defined surface wherein the point on the shot line is a first linear distance from the (intersection point) aiming point;
c. selecting an optimum bounce point for a basketball bouncing off the return origination surface, the optimum bounce point being the first bounce point after the basketball departs the return origination surface;
d. placing a floor target on the defined surface, the floor target having a center positioned at the optimum bounce point, wherein the center is a second linear distance from the intersection point, wherein the floor target is positioned between the hoop target and the point on the shot line;
e. determining a point of release for a shooter, the point of release being a third linear distance from the intersection point;
f. positioning the shooter at the point on the shot line, wherein positioning includes establishing a shooter stance and a shooter's optimum hand and elbow position relative to the backboard;
g. aiming for the top aiming indicia on the hoop target, wherein the shooter does the aiming while holding the basketball primarily with a right hand or left hand;
h. throwing and releasing the basketball at an angle resulting in an arc path towards the top aiming indicia, wherein the throwing and releasing is from the point of release;
i. bouncing the basketball off of the top aiming indicia, the bouncing being a first bounce;
j. bouncing the basketball off of the defined surface;
k. scoring and recording the bounce of the basketball off defined surface relative to the floor target, wherein the floor target has a scoring system thereon, the scoring system having numerical scores related to the proximity of the basketball bouncing at the optimum bounce point;
l. repeating the positioning, throwing, bouncing and scoring for at least three variations; and
m. summing the total of the scores.

DETAILED DESCRIPTION

Figure 1:
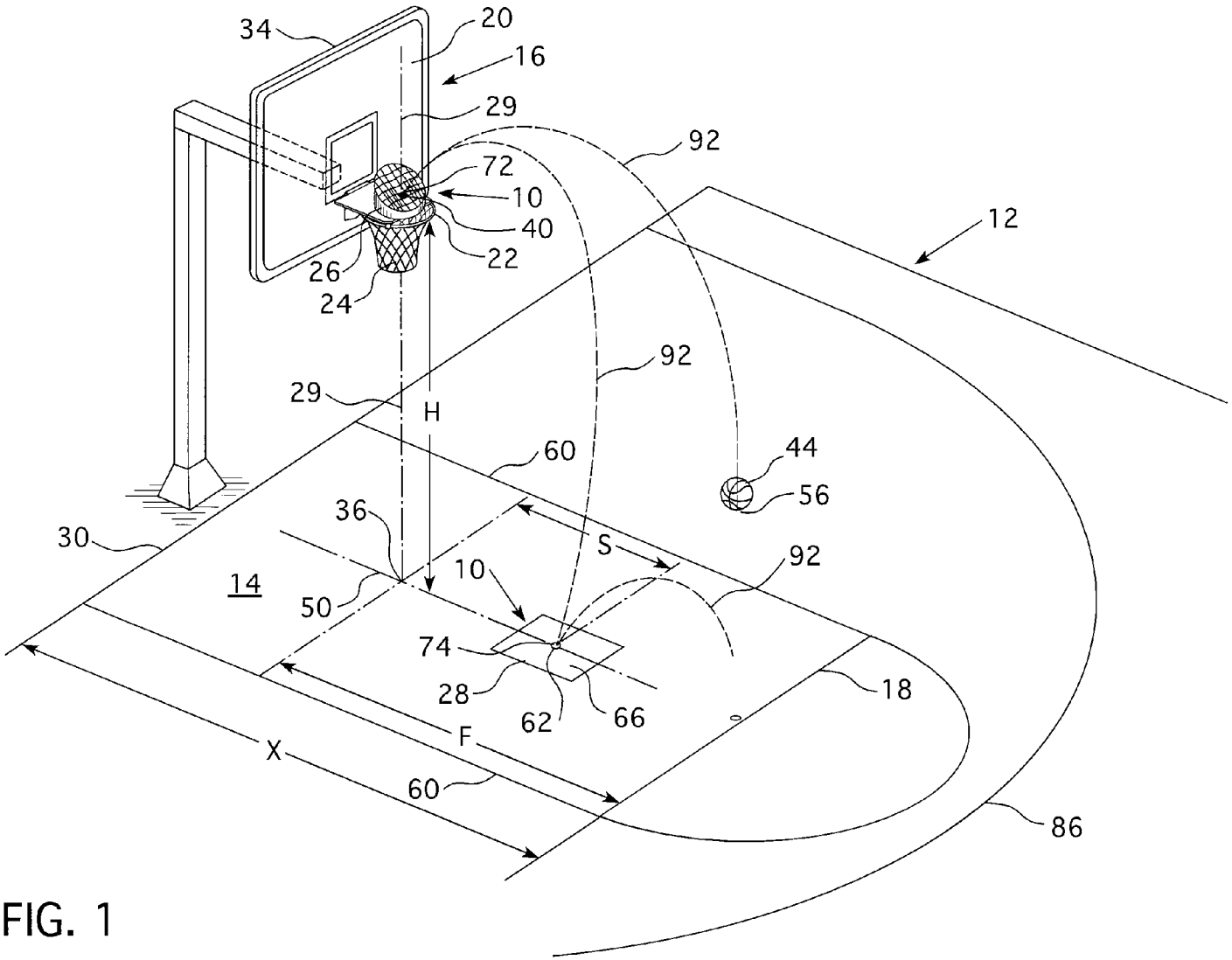
FIG. 1 is a perspective view of the training device, floor target and basketball as used on a standard basketball court.

Referring to FIG. 1, training device 10 according to one embodiment of the disclosed invention is illustrated as used on a standard basketball court 12. Basketball court 12 includes at least one free-throw lane 14 and at least one basketball goal 16. Free-throw lane 14 has free-throw line 18, or shot line 18. In the standard basketball court, free-throw lane is about 12 feet wide and about 19 feet long (about 3.7 meters wide and about 5.8 meters long). Basketball goal 16 has backboard 20, rim 22 and net 24. In this embodiment, training device 10 includes hoop or first target 26 and floor or second target 28. Rim 22 has a vertical center axis 29 passing through the center of rim 22.

Basketball court 12 is one type of defined surface 12 having a first end 30 and a second end 32, with at least one free-throw lane 14 positioned at first and second ends 30, 32. One basketball goal 16 is positioned above free-throw lane 14 at a set height H. Backboard 20 is perpendicular to defined surface 12 forming a perpendicular plane 34 with defined surface 12. Perpendicular plane 34 intersects defined surface 12 at intersection point 36. Similarly, center axis 29 also intersects defined surface parallel with perpendicular plane 34 at intersection point 37. A first linear distance 38 is formed between intersection point 37 and free-throw line 18. In the standard basketball court, first linear distance 38 is about 13 feet nine inches (about 4.2 meters). Other types of defined surfaces include gymnasiums, driveways, playgrounds or any other type of generally flat surface where a free-throw lane and/or three-point line may be placed.

Hoop target 26 is illustrated as being positioned above and laterally centered over rim 22. Centering is from the perspective looking upon rim 22 from higher position.

Rim 22 has net 24 affixed thereto. Hoop target 26 is positioned such that an angle of entry into net 24 for ball 44 is optimized from the free throw line 18 or the three-point line 86. The optimum angle of entry for each shot location varies due to the increased distance and speed of ball 44, which anticipates a decreased angle of entry for the three-point shot over the free-throw shot. Hoop target 26 has top aiming indicia 40. Hoop target 26 may be fabricated out of most any material capable of providing some form of bounce. Some non-limiting examples include wood, aluminum, and suitably non-flexing plastic.

Figure 2:
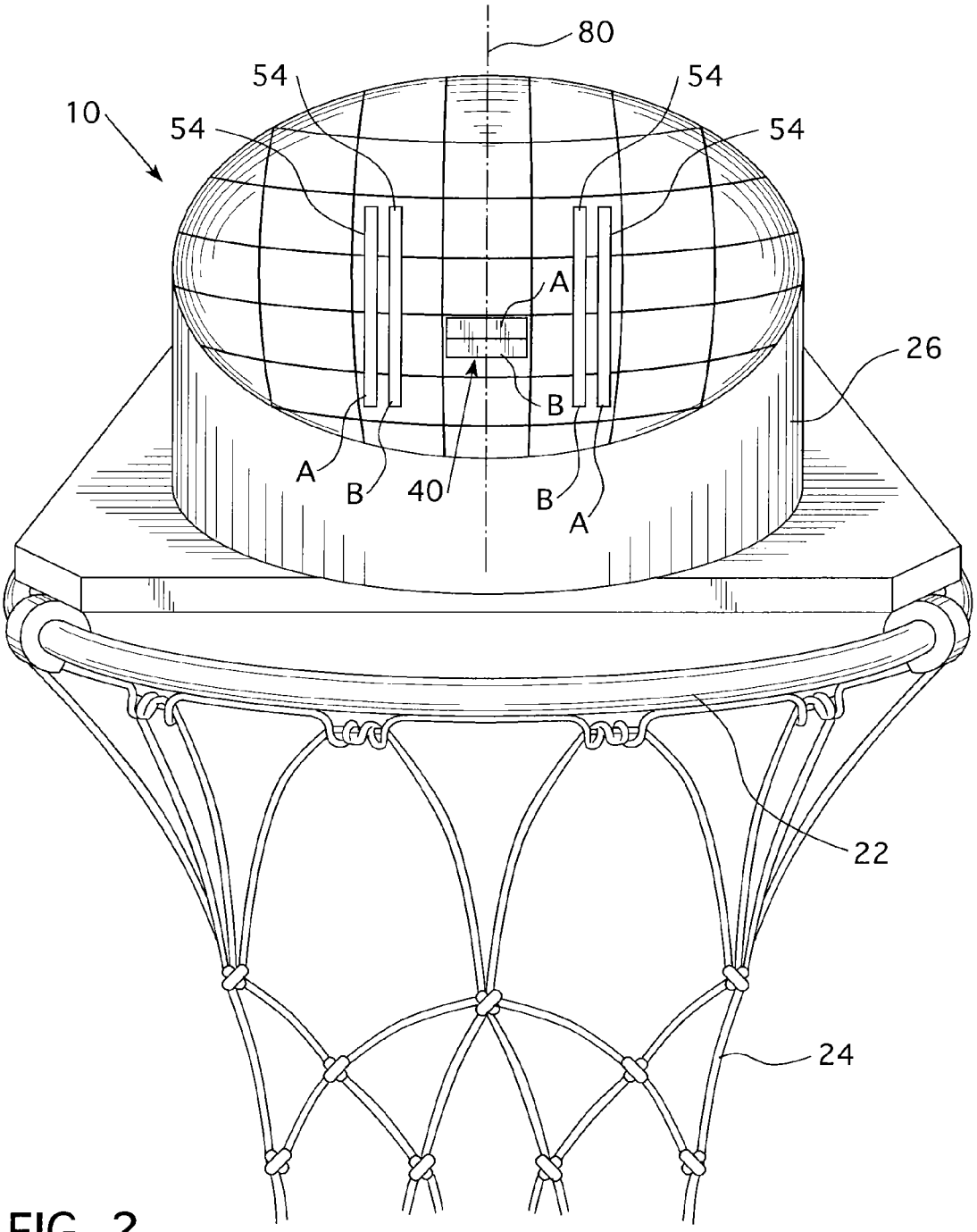
FIG. 2 is a perspective view of the training device mounted on a basketball hoop.

As illustrated in FIG. 2, a non-limiting example, hoop target 26 is generally cylindrical/elliptical and has a hyperbolic parabaloid shaped surface 42 also referred to as return origination surface 42. Hoop target 26 is shaped to have an interaction with ball 44 to represent a successful shot on a plurality of surface points 52 to generally replicate the center, front, back and circumference of rim 22. Return origination surface 42 is oriented towards free-throw line 18. Hoop target 42 can be any shape as long as return origination surface 42 and top aiming indicia 40 are positioned for an optimum shot and capable of bouncing ball 44 towards floor target 28. Top aiming indicia 40 coincides with path of last touch point on ball 44 of operator's finger of last touch upon release.

When viewed from the perspective view, hoop target 26 has concave surface 46 and convex surface 48 extending outward from a target centerline 50. Concave surface 46 controls the side-to-side return of ball 44 and convex surface 48 controls the front-to-back return of ball 44. Convex surface 48 has a trough 49 and an increasingly and decreasingly angled slope of return origination surface 42 as return origination surface 42 is viewed towards the proximal and distal edges respectively. Concave surface 46 is configured to provide a focused deflection of ball 44 when ball 44 impacts hoop target 26. This impact results in a return path within reach of the operator. As used herein, operator is the person shooting ball 44 towards a target, and may also be referred to as the shooter.

Still referring to FIG. 2, return origination surface 42 of hoop target 26 further has a plurality of surfaces points 52 thereon. Top aiming indicia 40 is positioned on return origination surface 42 within operator line-of-sight 54 of an operator (not shown) and the point of release 56. Top aiming indicia 40 has line-of-sight indicators 58. Line-of-sight indicator 58 is illustrated with at least two colors positioned at slight angles relative to the line-of-aim to allow the operator to align their shooting position at the point of release 56. As illustrated, line-of-sight indicator 58 has at least first color A and second color B. In one embodiment, color A is cyan and color B is magenta, and color A and color B are positioned laterally from the line-of-aim on both sides of the line-of-aim. This positioning facilitates use by either right-handed or left-handed operators who have a wide range of size, height and arm reach. The positioning of color A and color B allows for the different operators to adjust varying degrees of divergence to facilitate determination of an angle of divergence from the line-of-aim to the line-of-sight, thereby aiding the operator to accurately position their stance to establish the launch point and to consistently align their point of release 56 within the plane of trajectory. With two lines on either side of the trajectory plane a total of 8 positioning markers are available, four each for right and left handed shooters of one handed released shots.

Additionally, ball 44 size, angle of launch (and resultant velocity of approach) of entry a high arcing shot and a low arcing shot will both have a point at which the same angle of descent will be achieved. The distance variation of said angle from the apogee of ball 44 will result due to time variation effect of gravity.

Using at least first color A and second color B, allows the indicia to change for each shot and first color A and second color B are alignment tools. The change to first color A and second color B indicia allows the operator/shooter to view narrow lines coincident with their line-of-sight as determined by one eye open (either eye) observation of said line and adjusting the stance so that line-of-sight provides a lateral distance determining position of stance. The lateral distance determining position of stance secures the proper/perpendicular plane of trajectory/launch of the practice shot.

Referring back to FIG. 1, free-throw lane 14 is an area on defined surface 12. FIG. 1 illustrates free-throw lane 14 with sides 60.

Floor target 28 is positioned within free-throw lane 14 and between sides 60. Floor target 28 has center 62 that is positioned a second linear distance S from intersection point 37. Floor target 28 is removable and reusable. Floor target 28 has at least one error indicator 66, which are decreasing scores and/or right and left markings.

Proximate to free-throw line 18 is point-of-release 56. Point of release 56 is a third linear distance F from intersection point 37. Point of release 56 and third linear distance F may be shorter than the shot line to intersection point 37. It depends upon the individual operator or shooter.

Hoop target 26, floor target 28 and free-throw line 14 are configured to provide a two-bounce return of ball 44, one bounce off of hoop target 26 and one bounce off of floor target 28. The third linear distance F for the point of release 56 will vary for individual shooters and is impacted by the individual shooter's physical attributes and technique.

In operation, training device 10 provides optimized training for an operator (not shown). The operation of training device 10 begins with the operator shooting or tossing ball 44 towards top aiming indicia 40 of hoop target 26. Hoop target 26 is positioned above rim 22 and net 24. An optimum shot from the operator causes ball 44 to impact top aiming indicia 40 in center 72, which is positioned between color A and color B. The position of center 72 of top aiming indicia 40 is configured such that ball 44 would pass through net 24 but for hoop target 26 being in the way.

Continuing with the optimum shot, ball 44 takes a first bounce 72 towards center 62 of floor target 28. Center 62 of floor target 28 is positioned on target centerline 50 to receive ball 44 after an optimum shot towards top aiming indicia 40 of hoop target 26. Upon impact with center 62 of floor target 28, ball 44 takes second bounce 74 towards the operator. It is understood that for a three-point embodiment with operator positioned behind arc 92 with point of release 56 near arc 92, more than two bounces may occur.

Figure 3A:
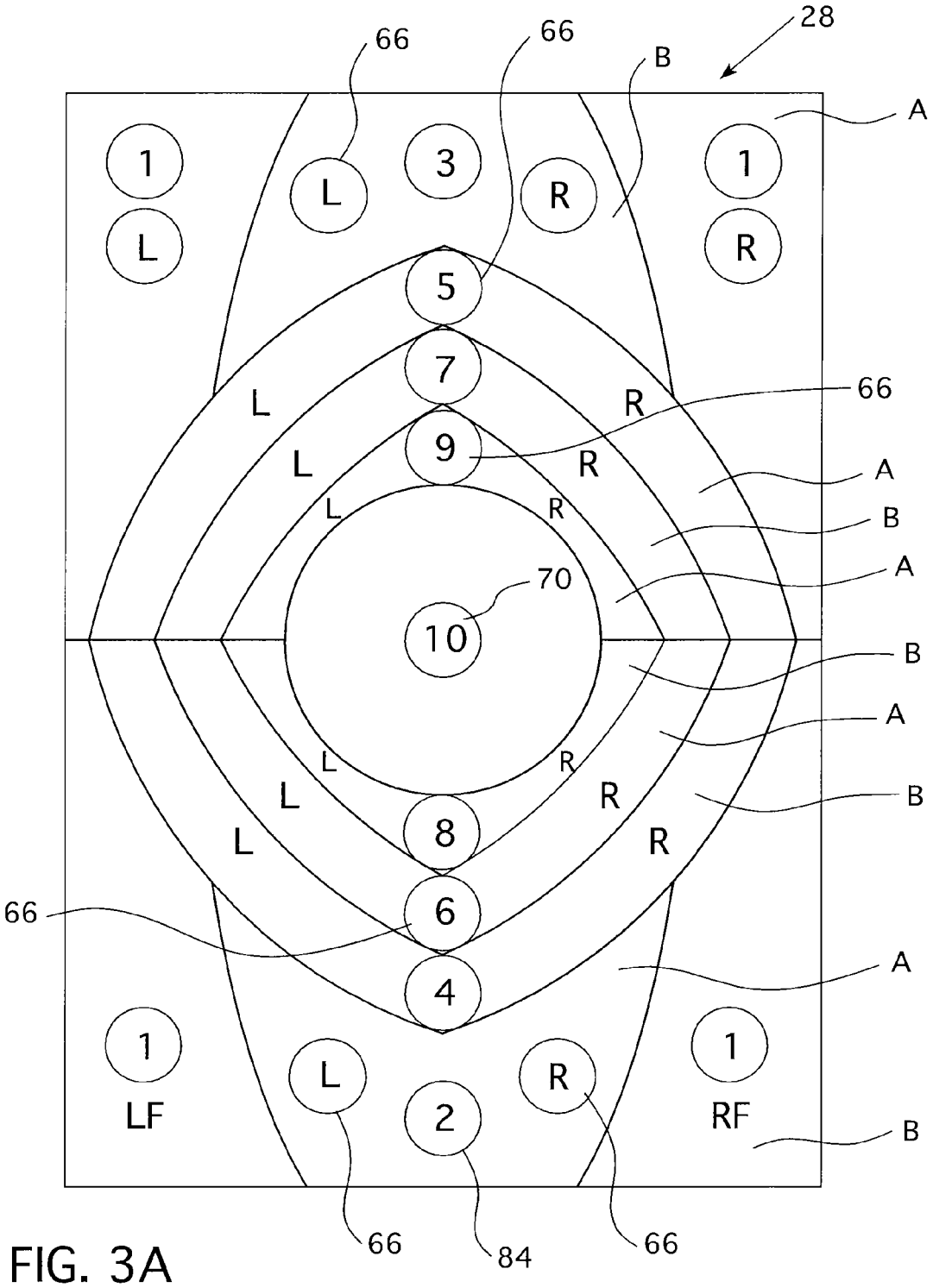
FIG. 3A shows an exemplary first embodiment of a floor target with respective target area and numeric values assigned.

Referring to FIG. 3A, one embodiment illustrates floor target 28 as having a plurality of center indicators 76 and a plurality of off-center indicators 78. Each of the center indicators 76 provide for decreasing score value the further away ball 44 lands from center 62 along centerline 80.

Off-center indicators 78 are positioned near edge 79, have lower score values than center indicators 76 and further identify left or right relative to hoop target 26 from the perspective of an operator. The lowest value off-center indicators 78 are closer to hoop target 26, distal from the operator, and the next lowest value off-center indicators 78 are furthest from hoop target 26, proximal towards the operator. The size of floor target can be any size providing information to the operator. In one non-limiting example, floor target is about two feet by three feet (about 0.6 meters by about 0.9 meters).

Figure 3B:
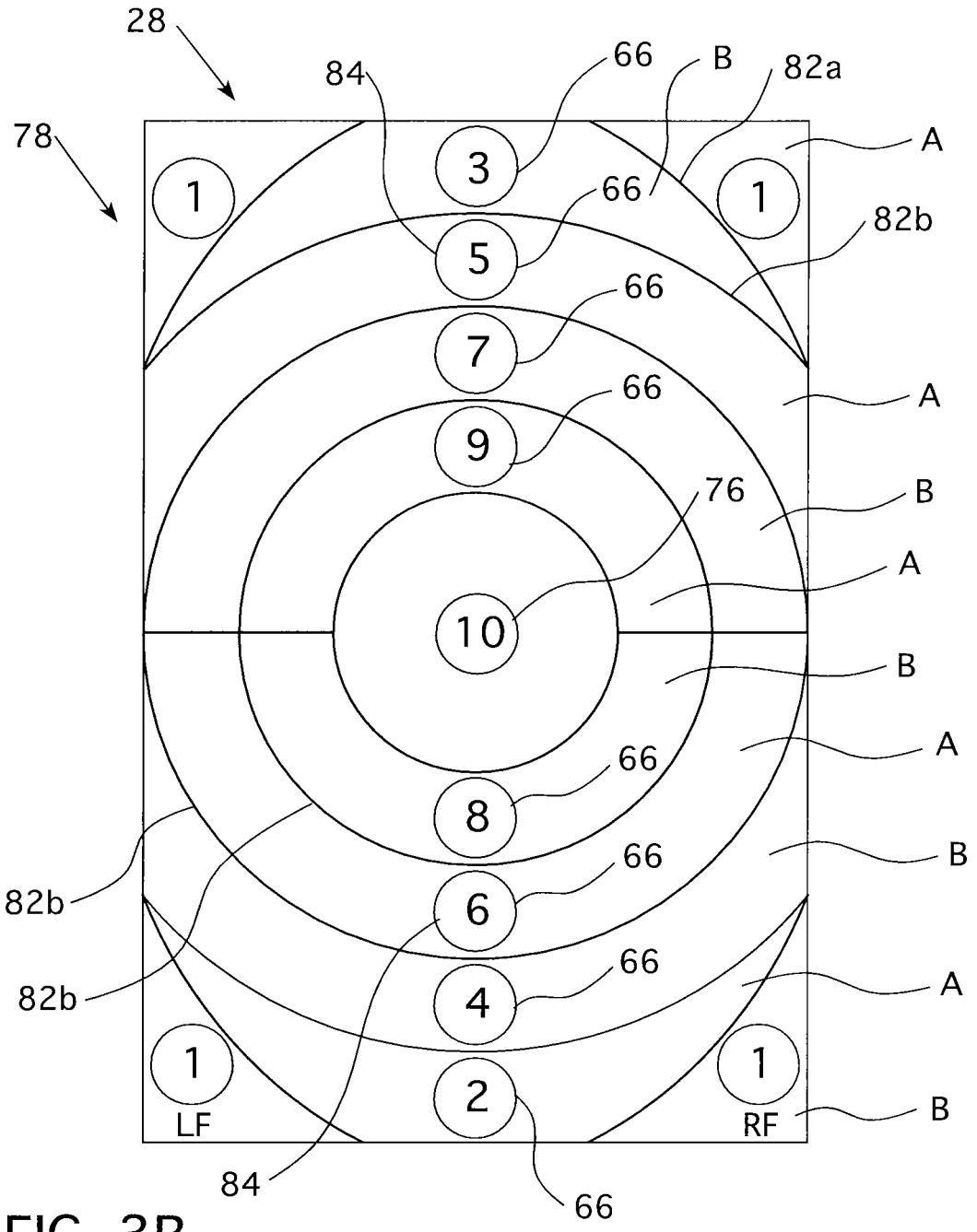
FIG. 3 B shows an exemplary second embodiment of a floor target.

Referring to FIG. 3B, another embodiment illustrates floor target 28 as having concentric circles 82 extending outwardly from center 62. Similar to the embodiment in FIG. 3A, concentric circles 82 have decreasing value as they extend from center 62. The lowest value concentric circle 82 is closest to hoop target 26, distal from the operator, and the next lowest value concentric circle 82 is furthest from hoop target 26, proximal to the operator. The outermost concentric circle 82*a* is illustrated as being partially on floor target 28. However, it is understood that floor target 28 can be fabricated to encompass the entirety of outermost concentric circle 82*a*. In addition, at least concentric circle 82*b* includes an off-center position value 84 for any left or right off-center impact on floor target 28. Off-center position value 84 is illustrated as a triangular shape extending outwardly from center 62.

Other embodiments of floor target 28 are anticipated and are considered as part of this invention. For example, an embodiment of combined intersecting circles and triangles extending outwardly from center 62 may be utilized. The importance to the operator is to understand the point of impact on return origination surface 42 and the impact on hitting center 62 with ball 44 from first bounce 72.

Training device 10 may be used by pre-positioning (for the operator's stance) top aiming indicia 40 and colors A and B with the visual operator line-of-sight 54. Operator line-of-sight 54 is determined through use of colors A and B of top aiming indicia 40. In one embodiment, a non-limiting example includes magenta for color A and the left eye operator line-of-sight 54 and cyan for color B and the right eye operator line-of-sight 54. In this embodiment, point-of-release 56 to top aiming indicia 40 requires the operator to shoot ball 44 in an arc 92.

Referring back to FIG. 1 in another embodiment, free-throw line 18 is replaced with three-point line 86. Three-point line 86 is a fourth linear distance from center axis 90 of rim 22. Three-point line 86 is also referred to as shot line 86. The placement of floor target 28 relative to three-point line 86 is similar to that used for free-throw line 18. A shot line further away from center axis 90 than three-point line 86 is also contemplated and will have a linear distance greater than fourth linear distance.

Use of the floor target helps provide accurate value determination and recording of each of a series of "bracketing practice sessions." Bracketing is discussed hereinbelow. Bracketing provides a record of relative success of respective variations of variables through successive approximation to achieve the most effective angle of entry and functional benchmarks. Bracketing includes, but is not limited to, relative foot placement, weight/balance, knee bend, hand placement on ball, relative placement of respective hands—shooting hand and off hand, pre-launch/shot placement of elbow, orientation of shooting thumb, and other variables including time of routine, number of bounces prior to pre-launch positioning, orientation of seams of ball and so forth.

The use of bracketing as a training technique allows for operator experimentation (with record keeping) to have changes made and have those changes be internalized and perhaps more importantly self determined.

The sequence of variables selected for use in bracketing sessions may be due to observed tendencies for overshooting, undershooting from previous observations or may be selected to aid shooter in acknowledging flawed mechanics in his or her shot approach which speeds the process to completing the transformation to best form by identifying the most beneficial changes early in the training process using the bracketing process to which claims are "herein" incorporated.

Prior to starting, the particular attribute to be evaluated and improved is selected and floor target 28 is positioned accordingly. For example, if the operator is evaluating and/or training from free-throw line 18, then floor target 28 is placed at second linear distance 64 from intersection point 37. In one embodiment, floor target 28 is placed at a known distance from intersection point 37 based upon historical data. Alternatively, floor target 28 is placed at second linear distance 64 based upon a matrix chart or by shot release point coordinates. Yet additional placement alternatives for floor target 64 include ball 44 size, angle of entry, operator height, etc.

In one alternate setup, a three-point shot embodiment using training device 10 is setup similar to the embodiment with free-throw line 18. In the three-point shot embodiment, the angle of entry for ball 44 to rim 22 is reduced as compared to that from free-throw line 18. Accordingly, hoop target 26 provides the operator with a reduced return origination surface 42 facing them. Three-point line 86 is the starting point for this alternate setup.

The first step is for the operator to select a point on three-point line 86 to train. That point is the fourth linear distance 88 from center axis 90. Floor target 28 placed on the floor between center axis 90 and the selected point on three-point line 86 with floor target center 62 at second linear distance 64. In this embodiment, second linear distance 64 is further from center axis 90 than the free-throw line 18 embodiment. Also, point-of-release 56 is proximate to three-point line 86 and is third linear distance 68 which is further than the free-throw line 18 embodiment. Hoop target 26, floor target 28 and three-point line 86 are still configured to provide a two-bounce return of ball 44, one bounce off of hoop target 26 and one bounce off of floor target 28 (or more for some three-point embodiments).

The use of the floor chart provides accurate value determination and recording of each of a series of "bracketing practice sessions" to provide a record of relative success of respective variations of variables. This is provided through successive approximation the most effective angle of entry and functional benchmarks including, but not limited to, relative foot placement, weight/balance, knee bend, hand placement on ball, relative placement of respective hands—shooting hand and off hand, pre-launch/shot placement of elbow, orientation of shooting thumb, and other variables including time of routine, number of bounces prior to pre-launch positioning, orientation of seams of ball and other similar variables.

The operator, the operator's coach and/or the operator's assistant determines the desired attribute and/or variable for bracketing and establishing at least one and up to n variations, descriptions, positions, actions of attribute and or variable being evaluated. In one embodiment, three different variations, descriptions, positions, actions of attribute and or variable are evaluated.

Figure 4:
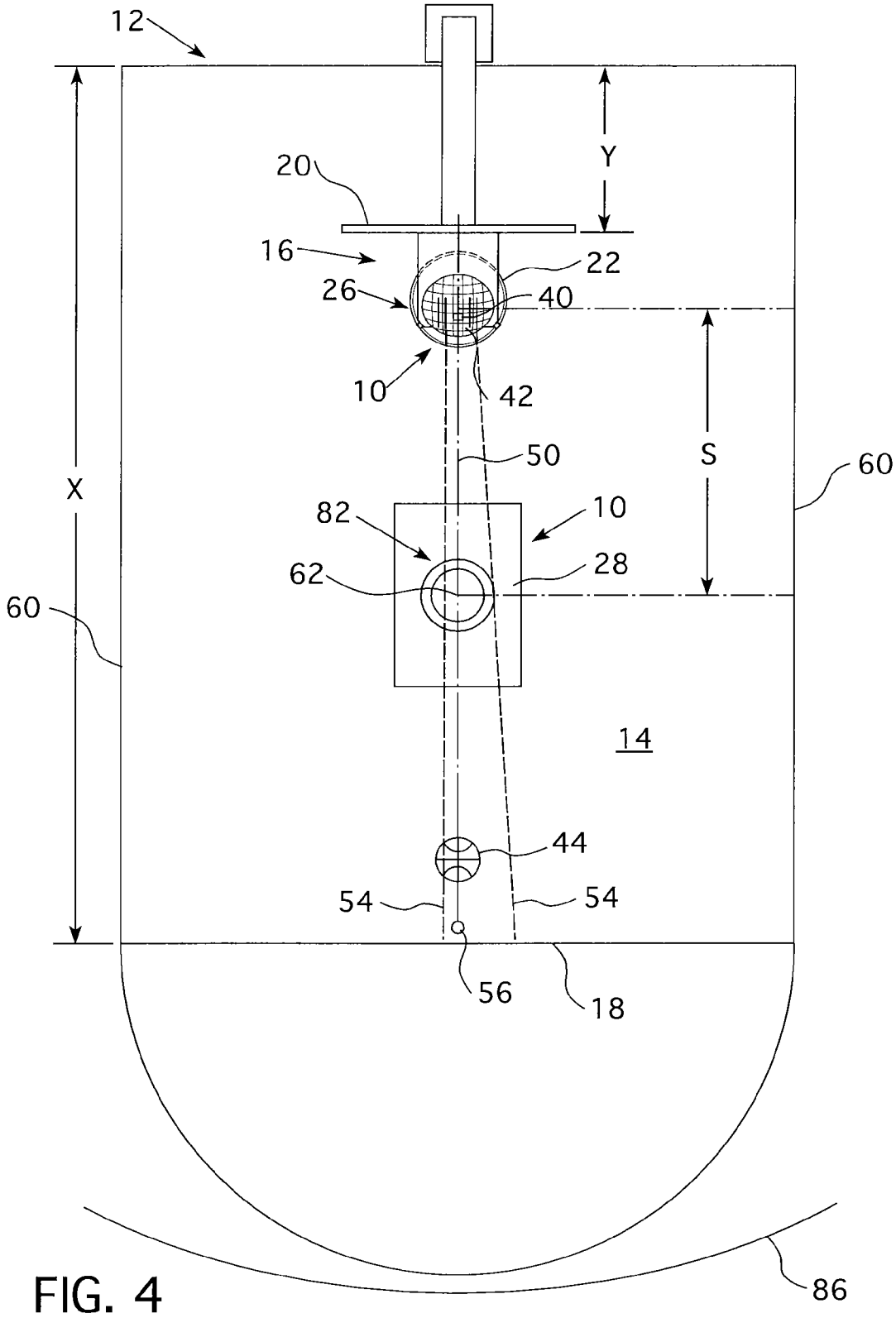
FIG. 4 is a top plan view of the entire training device, floor target, ball, the operator's line of sight and point of release installed on a basketball free throw lane.

Referring to FIG. 4 once setup, training device 10 can be used to establish baseline data and bracketing. Bracketing as used herein means the bracketing n number foot positions and shooting a defined number of shots from that position. By way of a non-limiting example, the operator may take shots with (a) both feet forward oriented towards backboard 20 and adjacent to free-throw line 18; (b) one foot adjacent to free-throw line 18 and one foot about 45 degrees from the foot adjacent to free-throw line 18 and positioned a comfortable distance away from the other foot; and (c) one foot adjacent to free-throw line 18 and one foot positioned behind that foot. There are numerous other foot positions that will work, but the process requires the selection of those foot positions be consistent for recording and bracketing. Once positioned as described above, for each position the operator takes n sets of shots from each position. In one embodiment, 10 shots at each position are taken. In another embodiment, 25 shots are taken at each position. The results are recorded as described herein. Analysis of the scores for each position are addressed and a determination is made as to the dominate or priority stance most beneficial to the operator. Additional stances may be explored to select the best stance. These additional stances are evaluated against the dominate or priority stance. The bracketing includes variables impacting the launch angle and the force exerted at launch.

An added advantage to the use of these components in tandem is a reduction in the introduction of error found in similar approaches to approximating the proper arch of a shot without considering the effect of air drag on the time associated with the basketball shot at a velocity and an angle of elevation to only satisfy the application of the motion equation.

There is a tangible advantage also is in that there is immediate feedback provided to the practicing basketball shooter which can be readily observed when the successful shot return strikes the numeric value printed on the floor chart 28 as the ball bounces once on its way back to the shooter.

The process of using bracketing of variables and charting a bracketing set of 10 or 25 shots per set of variable can provide a numeric report such as 60-70 for a set of 10 for a good shooter; 40-50 for a fair shooter; and 80-90 for an excellent shooter. Similarly, for a set of ten shots a score of 75-85 for a poor shooter in a set of 25 or perhaps approaching 200 for an excellent to exceptional shooter.

The charting of results may provide statistical anomalies which may lead to altering the point of aim as well as determining the most appropriate/successful angle of entry to employ as a benchmark and then developing administrative adaptations within game conditions to adjust for adrenaline/emotion/fatigue may allow for "called" adjustments from the bench to make in-game adjustments.

Figure 5:
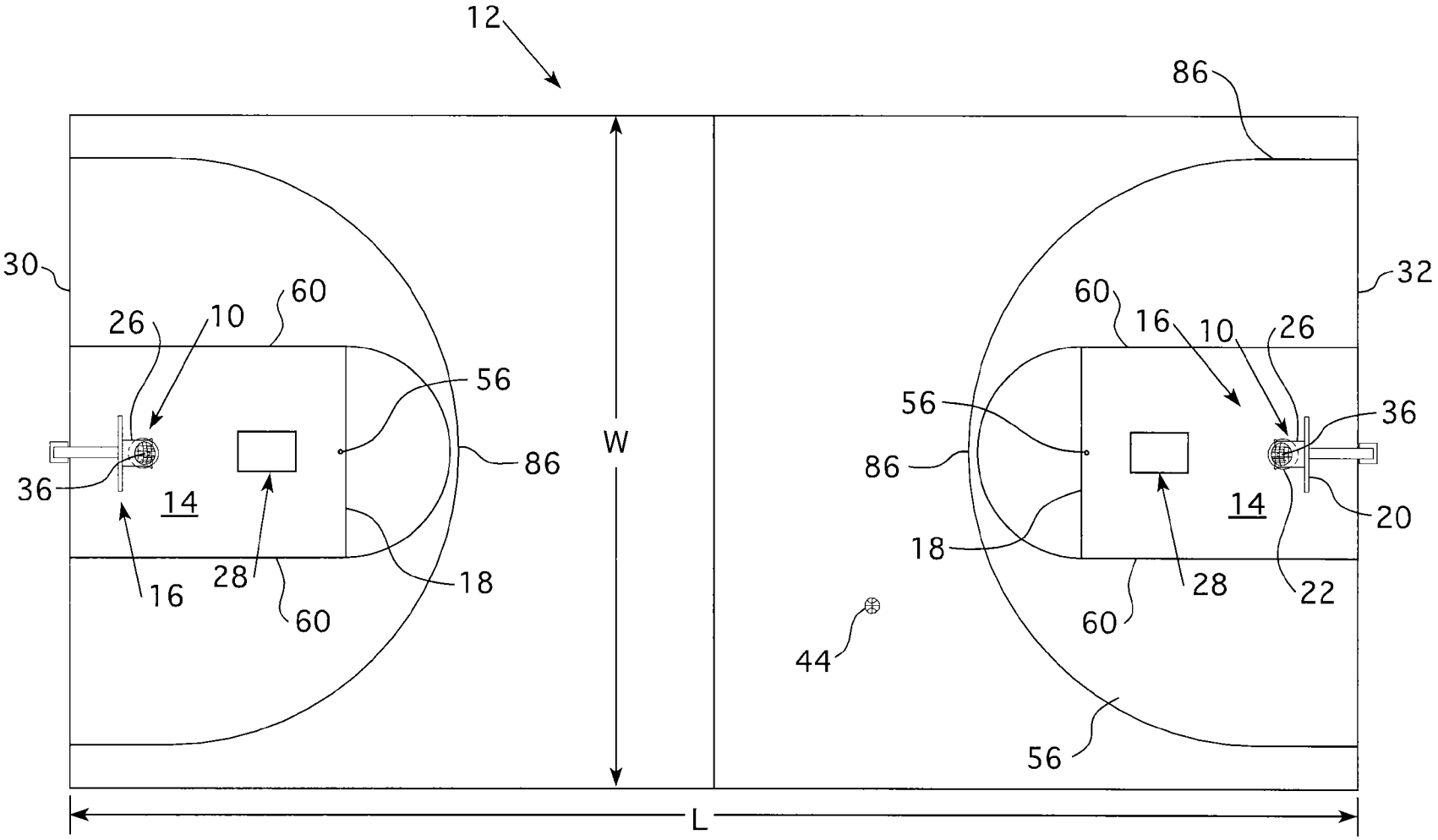
FIG. 5 is a top plan view of the training device, floor targets used on a full basketball court.

Referring to FIG. 5 after setting up training device 10, using training device 10 requires the operator to first select an appropriate sized ball 44 for shooting towards hoop target 26. The operator selects a preferred position and stance relative to hoop target 26 and backboard 20. The preferred position and stance is one that aligns point-of-release 56 in a plane perpendicular to backboard 20 and center axis 90 of rim 22.

An operator assistant, who may be a coach, trainer or anyone else assisting, records multiple attributes and variables of the operator, including operator hand position, number of bounces of ball 44 taken by operator, if any, operator's knee bend, and other such physical attributes that affect the operator's shooting.

Other attributes and variables include the starting position of ball 44 in relation to the operator's body and or position of the operator's elbow, which may influence or reduce tendencies described as pranation and supination. The operator assistant may record these variables on paper, in a computer, or with any other media that allows documenting and tracking of the operator's performance. Recording may be done on paper, electronically on a smart phone, tablet, computer or other such electronic device, or on video.

The operator completes a sample set of shots where the operator shoots ball 44 towards hoop target 26 to calibrate the set-up of training device 10. If adjustments to training device 10 are required, adjustments can be made and the process repeated. In one embodiment, the operator shoots at least three shots towards hoop target 26 as a sample set of shots/defined set of shots.

Once set, operator shoots a defined set of shots using ball 44 towards hoop target 26. The defined set of shots is at least three. However, the operator may set a larger set of shots and apply the set of shots consistently. The operator assistant records the results of ball 44 impact on floor target 28. The results include the recording the score of ball 44 hitting floor target 28. The operator reviews the recorded results and may elect to continue by adjusting the shooting attributes or variables necessary to improve the scoring on floor target 28.

In addition to the single set of shots using ball 44, hoop target 26 adjusts to provide a plurality of targets for simulating game conditions for three-point practice shots. Hoop target 26 is rotatably adjustable about center axis 90.

This adjustability provides customization of set/fixed angles of entry to satisfy each respective operator's preferred angle of entry and release "spot up point." For example, a point guard at top of "key" will shoot for target point 26*a*. Another example is the shooting guard orienting for a shot at target point 26*b*. Still another example is the wing shooting for target point 26*c*. A forward and a center may have shooting points 26*d* and 26*e*, respectively, for their shot release points. The shot release points are positioned behind three point line 86 at varying angles between −90 and +90 degrees relative to backboard 20 and center axis 90. Many shots will be ±45 such as 45 degrees relative to the backboard 20 and center axis 90.

As configured training device 10 and hoop target 26 will support up to five different players for concurrent use. If two hoop targets 26 are setup on both ends of a basketball court, a total of ten players in simulated game condition are able to shoot and pass as a practice session. In this embodiment, hoop target 26 is adjusted to provide a single face in one direction with the other positions having different look angles to hoop top aiming indicia 40.

When complete, the operator and operator assistant agree on the score results or agree to track different score results. Different score results may exist based upon angle or position differences between the operator and operator assistant during the observations of the shots.

For scoring the sum of the points from ball 44 hitting floor target 28 are entered. Additional parameters such as right or left scoring are entered to determine necessary adjustments the operator must make to improve. After assessing the scoring and determining the training adjustment, the process is repeated. The results are recorded and may be reported to a coach or trainer and/or tracked by operator for self-improvement.

Trainer, operator and score person are able to comprehend the outcome as measured in the sum of the score for a particular training session. By summing each session as a measure of establishing an operator shooting preference within the range of variables being tested, and by ratifying and recording the results for consideration and assessment by the trainer, operator and/or score person to modify the shot methodology. Having ball 44 bounce into center 64 of floor target 28 may not always provide the best results for individual operators. Consistent shooting with successful impact on hoop target 26 is a desired outcome.

In addition to scoring, the operator and/or operator assistant can determine the accurate perception of maximum successful shot description, increased accuracy, target and return to shooter function incorporated into one component, chartable recording provisions, adjustable by prescription which may include various angles of entry, ball sizes and points of release (player height) and shot distances. From this information, they can define the finite points of aim to maximize the plus or minus tolerance for a successful shot. Additionally, an optional margin that is laterally defined is disposed above the rim target surface to provide for a reflecting surface of a successful shot. In some cases, a successful shot means one which may only touch the inside of the rim once on its way through the basketball hoop or may be a clean shot without touching the rim.

Figure 6:
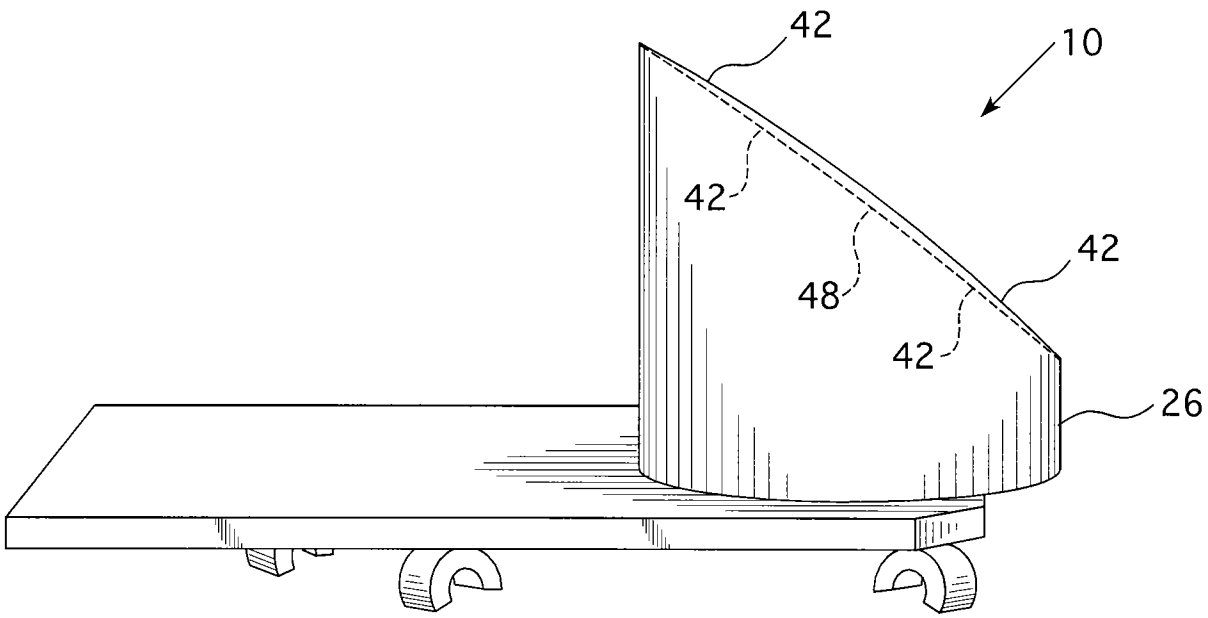
FIG. 6 is a left side perspective view of the training device.

FIG. 6 As a training tool training device 10 allows for the visualized angle of entry to rim 22. This visualized angle is comprised of a point of aim visually marked on the physical "above the rim structure"—within the cylinder target, coupled with either a physical mark positioned/suspended immediately above the front of the rim or a laser imaged point of reference projected in a similar proximity to define by two fixed points or an operator's visualized point in space. The optimal angle of entry adjusted to shooter, ball size, which includes aiming points which prescribe an angle of entry to the basket. Aiming point one is on the actual physical target (hyperbolic paraboloid) which features: two blocks of different colored indicia.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

In a method of use, a three-point shot embodiment uses training device 10 in a manner similar to that of the method from free-throw line 18. In this embodiment, the angle of entry for ball 44 to rim 22 is reduced as compared to that from free-throw line 18. Accordingly, hoop target 26 provides the operator with a reduced return origination surface 42 facing them. In this method, the operator has a reduced set of angles of entry, thereby requiring reduci4ng the range of adjustment required for the completion of the bracketing by angles.

In the three-point shot embodiment, the operator selects the point of release behind three-point line 86 to train. That point is the fourth linear distance 88 from center axis 90. Floor target 28 placed on the floor with floor target center 62 at second linear distance 64. In this embodiment, second linear distance 64 is measured from center axis 90 instead of being measured from intersection point 37. For this embodiment, point-of-release 56 is proximate to three-point line 86 and third linear distance 68 is measured from center axis 90 instead of being measured from intersection point 37. Hoop target 26, floor target 28 and three-point line 86 are configured to provide a two-bounce return of ball 44, at least one bounce off of hoop target 26 and one bounce off of floor target 28. The at least one bounce off of hoop target 26 may also include successively lower contact with rim 22.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A training device comprising: a basketball goal having a backboard, a rim and a net; a center axis disposed through the rim; a defined surface having the basketball goal positioned thereabove a set height, wherein the backboard is perpendicular to the define surface, wherein the center axis is parallel with the backboard and intersects the defined surface at an intersection point; a first linear distance between a point on a shooting line and the intersection point; a hoop target affixed to the basketball goal and positioned above the rim in a position centered over the rim; a floor target positioned on the defined surface, the floor target being removable and having a center indicator and at least one error indicator, wherein the floor target is positioned a second linear distance from the intersection point; a top aiming indicia positioned on the hoop target and visible from the shooting line; and wherein the position of the hoop target and the floor target are configured to provide optimized training for an operator shooting a basketball from the point on or near the shooting line towards the hoop target, wherein an optimum shot is when the operator shoots the basketball toward the top aiming indicia and the basketball bounces back towards the operator and lands in the center indicator and further bounces back to the operator and the hoop target further comprises a body being generally cylindrically shaped and having a hyperbolic parabolic shaped surface, wherein the hyperbolic parabolic shaped surface has a concave surface and/or a convex surface, the concave and/or convex surfaces configured to provide a return origination surface; a target centerline, wherein the concave surface extends outwardly therefrom; a trough positioned on the convex surface, wherein the convex surface further comprises an increasingly angled slope towards at least one lateral edge wherein the convex surface further has a mid-line hump perpendicular to plane of trajectory and extends distally toward back board and proximally toward shooting line; a first color associated with the top aiming indicia; and a second color associated with the top aiming indicia.

2. The training device of claim 1, wherein the shooting line is a free-throw line.

3. The training device of claim 1, wherein the shooting line is a three-point line.

4. The training device of claim 1, wherein the hoop target is adjustable to be oriented towards the point on the shooting line.

5. The training device of claim 1, wherein the defined surface is a common basketball court.

6. The training device of claim 1, wherein the shooting line is longer than the three-point line.

7. A method of training to shoot a basketball utilizing the device of claim 1, the method comprising: positioning a hoop target above a rim of a basketball goal backboard, wherein the hoop target has a return origination surface with a top aiming indicia thereon and is centered on a center axis of the rim, wherein the center axis is parallel to a plane of the backboard and intersects a defined surface below the rim at an intersection point; selecting a point on a shot line, the shot line being on the defined surface wherein the point on the shot line is a first linear distance from the intersection point; selecting an optimum bounce point for a basketball bouncing off the return origination surface, the optimum bounce point being the first bounce point after the basketball departs the return origination surface; placing a floor target on the defined surface, the floor target having a center positioned at the optimum bounce point, wherein the center is a second linear distance from the intersection point, wherein the floor target is positioned between the hoop target and the point on the shot line; determining a point of release for a shooter, the point of release being a third linear distance from the intersection point; positioning the shooter at the point on the shot line, wherein positioning includes establishing a shooter stance and a shooter's optimum hand and elbow position relative to the backboard; aiming for the top aiming indicia on the hoop target, wherein the shooter does the aiming while holding the basketball with a right hand or left hand; throwing and releasing the basketball in an arc towards the top aiming indicia, wherein the throwing and releasing is from the point of release; bouncing the basketball off of the top aiming indicia, the bouncing being a first bounce; bouncing the basketball off of the defined surface; scoring and recording the bounce of the basketball off defined surface relative to the floor target, wherein the floor target has a scoring system thereon, the scoring system having numerical scores related to the proximity of the basketball bouncing at the optimum bounce point; repeating the positioning, throwing, bouncing and scoring at least three times; and summing the total of the scores.

8. The method of claim 7, further comprising the step of evaluating the score.

9. The method of claim 8, further comprising the step of adjusting the positioning of the shooter to improve score.

10. The method of claim 8, further comprising repeating the positioning, throwing bouncing, scoring, summing and evaluating from a new point on the shot line.

11. The method of claim 7, wherein the placing of the floor target on the defined surface includes placing the floor target on a floor.

12. The method of claim 7, wherein the step of selecting a point on a shot line further comprises selecting a point on a free throw line.

13. The method of claim 7, wherein the step of selecting a point on a shot line further comprises selecting a point on along a three-point line.

14. The method of claim 7, wherein the top aiming indicia has at least a first color and a second color, wherein the step of aiming further comprises the shooter selecting aligning the first color or second color in a shooter line of sight, and releasing the basketball towards the first color or second color in the arc.

* * * * *